US006572426B1

(12) United States Patent
Inazuru

(10) Patent No.: US 6,572,426 B1
(45) Date of Patent: Jun. 3, 2003

(54) METHOD FOR PRODUCING X-RAY TUBE

(75) Inventor: Tutomu Inazuru, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/555,608

(22) PCT Filed: Dec. 4, 1998

(86) PCT No.: PCT/JP98/05485

§ 371 (c)(1),
(2), (4) Date: May 31, 2000

(87) PCT Pub. No.: WO99/28941

PCT Pub. Date: Jun. 10, 1999

(30) Foreign Application Priority Data

Dec. 4, 1997 (JP) ..... 9-334363

(51) Int. Cl.[7] ..... H01J 9/26
(52) U.S. Cl. ..... 445/28; 445/43
(58) Field of Search ..... 445/28, 43

(56) References Cited

U.S. PATENT DOCUMENTS 6,015,325 A * 1/2000 Inazuru et al. ..... 445/28

FOREIGN PATENT DOCUMENTS

| | | |
|---|---|---|
| JP | A-61-294737 | 12/1986 |
| JP | A-9-180630 | 7/1997 |
| JP | A-9-180660 | 7/1997 |

* cited by examiner

*Primary Examiner*—Kenneth J. Ramsey

(57) ABSTRACT

An x-ray tube is provisionally assembled by interposing an upright part (12A) projecting from a first brazing agent (A) between a stem (3) and a bulb (2), and by interposing a second brazing agent (B) between the bulb (2) and an output window (4). This temporary assembly is conveyed into a vacuum brazing oven (P). Since a gap (K) is provided between the stem (3) and the bulb (2) by the upright part (12A), gas inside the bulb (2) can be discharged through the gap (K). Then, the vacuum brazing oven (P) is heated to a predetermined temperature to melt the first and second brazing agents (A, B), to thus fuse-bondingly fix the stem (3) and the output window (4) to the bulb (2). Brazing connection is completed in the vacuum brazing oven (P) while maintaining the sealed vessel (7) in a high vacuum condition without provision of a discharge pipe in the stem (3).

13 Claims, 7 Drawing Sheets

METHOD FOR PRODUCING X-RAY TUBE

TECHNICAL FIELD

The present invention relates to a method for producing an x-ray tube, and more particularly, to the method for producing the x-ray tube wherein a ceramic bulb, a ceramic stem, and an output window are brazed together using a brazing agent.

BACKGROUND ART

Japanese Patent Application Publication (Kokai) Nos. HEI-9-180630 (corresponding to U.S. patent application Ser. No. 09/113,372) and HEI-9-180660 (corresponding to U.S. patent application Ser. No. 09/113,371) disclose technologies in this field. In the disclosed method for producing the x-ray tube, at a position outside of a vacuum brazing oven, a stem is set through a brazing agent at one end of a bulb, and an output window is set through a brazing agent at another end of the bulb. The thus pre-assembled x-ray tube is conveyed into the vacuum brazing oven, and the oven is heated at high temperature for melting the brazing agent after the oven is evacuated to $1\times10^{-6}$ Torrs. Thus, a combination of the bulb, the stem and the output window provides a sealed vessel in the oven. Thereafter, the x-ray tube is taken out from the oven, and then, further evacuation is carried out with respect to an inside of the sealed vessel through a discharge pipe provided at the stem to provide high vacuum condition. Then, the discharge pipe is plugged. In this way, connection of components using the brazing agent improves assembleability of the x-ray tube.

However, the following problems remain in the conventional x-ray tube due to the above-described production method.

That is, for connecting each component of the x-ray tube with brazing, high vacuum is provided in the oven and the brazing agent is melted by heating the oven. Upon completion of the brazing, the assembled x-ray tube is taken out from the oven, and high vacuum is again provided in the sealed vessel through the discharge pipe. Accordingly, the evacuation process is performed twice, which is a task to be solved for improving an efficiency of assembly of the x-ray tube.

It is an object of the present invention to overcome the above-described problems and to provide a method for producing the x-ray tube capable of improving assembling efficiency thereof.

DISCLOSURE OF THE INVENTION

To attain the above described object, the present invention provides a method for producing an x-ray tube which includes a sealed vessel provided with a bulb having one open end and another open end, a stem fixed to the one open end of the bulb through a first brazing agent, and an output window fixed to the another open end of the bulb through a second brazing agent, a filament disposed in the sealed vessel for emitting electrons, and a focussing electrode disposed in the sealed vessel and surrounding the filament, incidence of the electron from the filament into the output window providing x-ray discharge outwardly through the output window, the method comprising the steps of;

interposing a flange portion of the focussing electrode between the bulb and the stem, the flange portion having an outer peripheral end portion provided with a skirt portion where a gas discharge port allowing an inside of the bulb to communicate with an outside is formed;

positioning a projecting portion of the first brazing agent between the stem and the flange portion of the focussing electrode for maintaining the stem away from the flange portion, and positioning a third brazing agent between the flange portion and the bulb, and positioning the second brazing agent between the bulb and the output window to provide a temporary assembly of the x-ray tube; and disposing the temporary assembly of the x-ray tube in a vacuum brazing oven, and discharging gas from an inside space of the vessel defined by the bulb, the stem and the output window through a gap between the flange portion and the stem, the gap being provided by the projecting portion of the first brazing agent.

According to the above-described method for producing the x-ray tube, the gap is positively provided between the stem and the flange portion by interposing the projecting portion of the first brazing agent between the stem and the flange portion. Thus, gas inside the bulb can be discharged through the gap in the vacuum brazing oven. While the discharge of gas from the inside space is continued, the projecting portion of the first brazing agent, the first brazing agent, the second brazing agent and the third brazing agent are melted by increasing the temperature of the vacuum brazing oven to a predetermined temperature to perform brazing connection between the flange portion and the stem, between the bulb and the flange portion, and between the bulb and the output window. In this way, brazing connection is completed in the vacuum brazing oven while maintaining the sealed vessel in a high vacuum condition without provision of a discharge pipe in the stem. That is, the x-ray tube without the gas discharge pipe can be fabricated with an advantage that the assembly of the x-ray tube is completed concurrently with the take-out of the x-ray tube from the vacuum brazing oven.

Further, gas discharge is achieved through the gap between the stem and the flange portion of the focussing electrode, and the flange portion of the focussing electrode is interposedly fixed between the bulb and the stem by melting the first and third brazing agents in the vacuum brazing oven. Consequently, the focussing electrode can be easily and stably fixed to the sealed vessel.

Furthermore, positioning of the focussing electrode with respect to the stem can be easily and reliably performed by simply positioning the stem into the skirt portion during assembly of the x-ray tube. Further, gas in the sealed vessel can be smoothly discharged through the gas discharge port formed in the skirt portion. That is, gas discharge from the sealed vessel can be assured by forming the gas discharge port in the skirt portion irrespective of the provision of the skirt portion at the focussing electrode.

In this case, preferably, the gas discharge port is positioned in association with the projecting portion of the first brazing agent. With this arrangement, since the gap between the bulb and the stem is stably provided by the projecting portion, more stable gas discharge is achievable by the alignment between the projecting portion and the gas discharge port.

Preferably, the projecting portion provided at the first brazing agent is formed of a material identical with the material of the first brazing agent. In this case, the first brazing agent is formed of a ring shaped sheet like member, and the projecting portion comprises an upright pawl formed by cutting a part of the first brazing agent and folding the cut part. By providing the projecting portion in this fashion, it is unnecessary to provide a separate projecting portion to the ring like main body of the brazing agent. The projecting portion can be easily provided as an upright pawl by forming L-shaped or U-shaped slit in the main body of the brazing agent and by folding the slitted part.

In the above described production method, preferably, the second brazing agent can have a projecting portion which spaces the output window away from the bulb to provide a gap through which gas discharge can be performed. With this arrangement, gas discharge at the both open ends of the bulb can be performed, to thus further promote gas discharge.

Similar to the projecting portion of the first brazing agent, the projecting portion at the second brazing agent is preferably formed of a material identical with the material of the second brazing agent. Further, the second brazing agent is preferably formed of a ring shaped sheet like member, and the projecting portion of the second brazing agent comprises an upright pawl formed by cutting a part of the second brazing agent and folding the cut part.

Preferably, a cap surrounding the output window is provided, and the output window is interposed between the bulb and the cap, and the second brazing agent is positioned between the bulb and the output window, and a fourth brazing agent is positioned between the output window and the cap. The second brazing agent has a projecting portion spacing the output window away from the bulb to provide a gap through which gas discharge is performed. With this arrangement, the output window can be interposed between the cap and the bulb by melting the second and fourth brazing agents in the vacuum brazing oven. Thus, the cap can protect the output window and can stably fix the output window.

Preferably, the cap includes a sleeve portion surrounding the end portion of the bulb and the sleeve portion is formed with a gas discharge port allowing an inside of the bulb to communicate with an outside. With this arrangement, the positional relationship among the output window, the cap and the bulb can be simply and stably determined by positioning the output window and the end portion of the bulb into the sleeve portion of the cap during assembly of the x-ray tube. Further, gas discharge out of the sealed vessel can be smoothly achieved through the gas discharge port formed in the sleeve portion. That is, stable gas discharge is achievable by forming the gas discharge port in the sleeve portion irrespective of the provision of the sleeve portion at the cap.

Preferably, the gas discharge port of the cap is positioned in association with the projecting portion of the second brazing agent. With this arrangement, more stable gas discharge can be achieved by the alignment between the projecting portion and the gas discharge port because the gap between the bulb and the output window can be stably maintained by the projecting portion.

Further, the present invention provides a method for producing an x-ray tube which includes a sealed vessel provided with a bulb having one open end and another open end, a stem fixed to the one open end of the bulb through a first brazing agent, and an output window fixed to the another open end of the bulb through a second brazing agent, and a filament disposed in the sealed vessel for emitting electrons, incidence of the electrons into the output window providing x-ray discharge outwardly through the output window, the method comprising the steps of;

interposing the output window between the bulb and a cap surrounding the output window, the cap having a sleeve portion surrounding the end portion of the bulb, the sleeve portion being formed with a gas discharge port which communicates the inside of the bulb with the outside, positioning the first brazing agent between the bulb and the stem, positioning a projecting portion of the second brazing agent between the bulb and the output window, and positioning a fourth brazing agent between the output window and the cap to provide a temporary assembly of the x-ray tube where the output window is spaced away from the bulb, and disposing the temporary assembly of the x-ray tube in a vacuum brazing oven, and discharging gas from an inside space of the vessel defined by the bulb, the stem and the output window through a gap between the bulb and the output window, the gap being provided by the projecting portion of the second brazing agent.

According to the above described method for producing the x-ray tube, the gap is positively provided between the output window and the bulb by interposing the projecting portion of the second brazing agent between the output window and the bulb. Thus, gas inside the bulb can be discharged through the gap in the vacuum brazing oven. While the discharge of gas from the inside space is continued, the first brazing agent, the projecting portion of the second brazing agent, the second brazing agent and the fourth brazing agent are melted by increasing the temperature of the vacuum brazing oven to a predetermined temperature to perform brazing connection between the bulb and the stem and between the bulb and the output window. In this way, brazing connection is completed in the vacuum brazing oven while maintaining the sealed vessel in a high vacuum condition without provision of a discharge pipe in the stem.

BEST MODE FOR CARRYING OUT THE INVENTION

A method for producing an x-ray tube according to preferred embodiments of the present invention will be described in detail with reference to the drawings.

Figure 1:
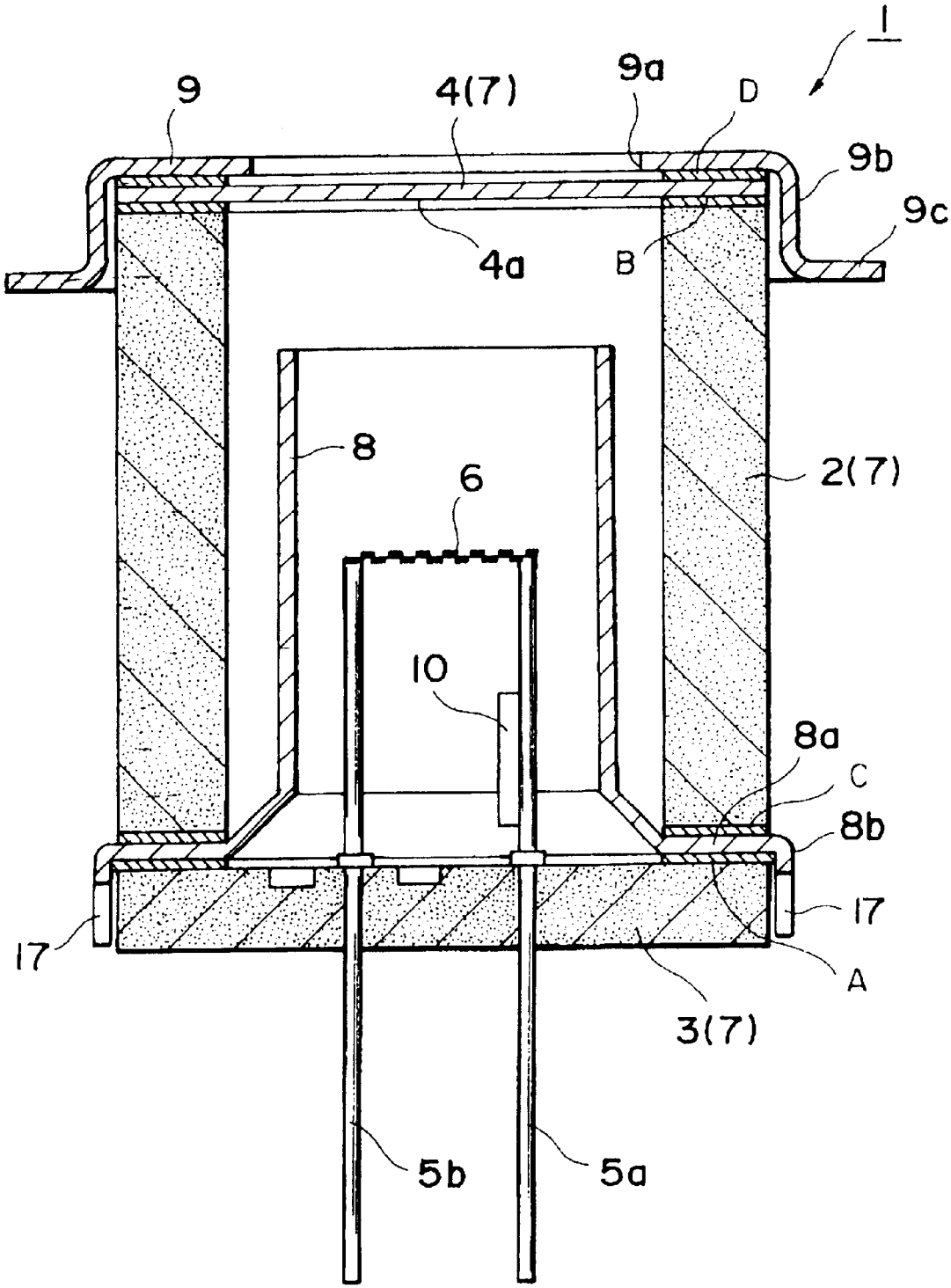
FIG. 1 is a cross-sectional view showing an x-ray tube produced by a production method according to the present invention.

FIG. 1 is a cross-sectional view showing the x-ray tube produced in accordance with the method of the present invention. The x-ray tube shown in FIG. 1 has an electrically insulative cylindrical bulb 2 formed from a ceramics. An electrically insulative disc shaped stem 3 formed from ceramics is fixed to one open end of the bulb 2. A disc shaped output window 4 is fixed to another open end of the bulb 2. A target metal 4*a* formed from W, Ti and the like is deposited on an inner surface of the output window 4.

Two cathode pins 5*a* and 5*b* in parallel with each other penetrate through and fixed to the center of the stem 3. In the bulb 2, an electron discharge cathode filament 6 is fixed so as to spin from a tip of the cathode pin 5*a* to a tip of the cathode pin 5*b*. A sealed vessel 7 is configured from the bulb 2, the stem 3, and the output window 4. Inside of the vessel 7 is maintained in a high vacuumed condition (for example, $1\times10^{-6}$ Torr). Therefore, the cathode filament 6 is disposed in a high vacuum.

Further the x-ray tube 1 has a cylindrical focussing electrode 8 formed from Kovar alloy in the sealed vessel 7. A donut shaped flange portion 8*a* radially outwardly protrudes from the lower end portion of the focussing electrode 8. By sandwiching this flange portion 8*a* between the bulb 2 and the stem 3, the focussing electrode 8 can be reliably fixed in the bulb 2. Further, an annular skirt portion 8*b* is formed in the outer peripheral edge portion of the flange portion 8*a*. An inner diameter of the skirt portion 8*a* is formed slightly greater than an outer diameter of the disc shaped stem 3 for surrounding the stem 3. Accordingly, when assembling the x-ray tube 1, the positional relationship between the stem 3 and the focussing electrode 8 can be simply and reliably determined by merely positioning the stem 3 within the skirt portion 8*b*.

Further, the x-ray tube 1 has a conductive metal cap 9 disposed on the output window 4. The cap 9 has a center portion formed with a circular opening 9*a* through which the output window 4 appears. The cap 9 has an annular sleeve portion 9*b* surrounding the end portion of the bulb 2 and the output window 4. Further, a flange 9*c* is provided at a free end of the annular sleeve 9*b* by bending the free end portion outwardly. In this way, by providing the sleeve portion 9*b* on the cap 9, then during assembly of the x-ray tube 1, the positional relationship among the output window 4, the cap 9, and the bulb 2 can be easily and reliably determined.

Each component of the x-ray tube 1 with this configuration is coupled and fixed together by brazing agent whose main component is silver (Ag) and moreover having a melting point of about 800 degrees centigrade. In concrete terms, connection portion of the stem 3 and the flange portion 8*a* of the focussing electrode 8 is coupled and fixed together by melting-a ring shaped first brazing agent A. The connection portion of the end of the bulb 2 and the output window 4 are coupled and fixed together by melting a ring shaped second brazing agent B. The connection portion of the other end of the bulb 2 and the flange portion 8*a* of the focussing electrode 8 is coupled and fixed together by melting a ring shaped third brazing agent C. The connection portion of the output window 4 and the cap 9 are coupled and fixed together by melting a ring shaped fourth brazing agent D. The brazing agents A, B, C and D will be described later. Incidentally, a getter 10 that is activated at brazing temperature (about 800 degrees centigrade) is provided in the vessel 7. The getter 10 is fixed onto the cathode pin 5*a*. Accordingly, any residual gas in the vessel 7 after assembly by brazing operation can be absorbed by the getter 10. By further increasing the vacuum within the vessel 7, the x-ray tube 1 with higher quality can be obtained.

In the x-ray tube with this configuration, x-ray is discharged to the outside from the output window 4 by electron discharged from the cathode filament 6 falling incident on the output window 4.

Next, a particular arrangement used for assembly of the x-ray tube will be described for the purpose of explanation of the method for producing the x-ray tube 1.

Figure 2:
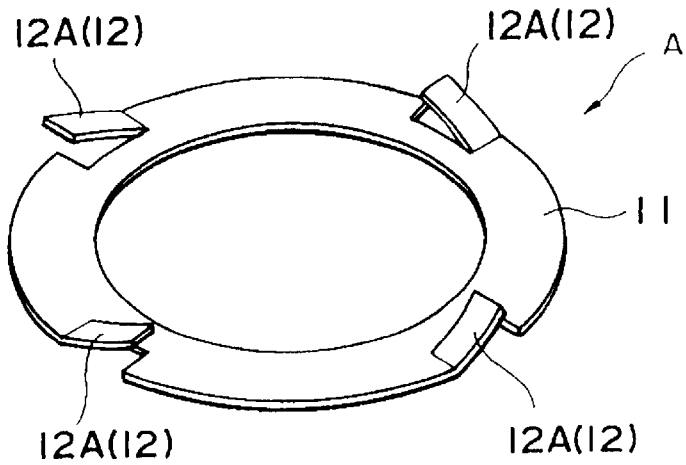
FIG. 2 is a perspective view showing a first brazing agent applied in the x-ray tube production method of the present invention.
Figure 3:
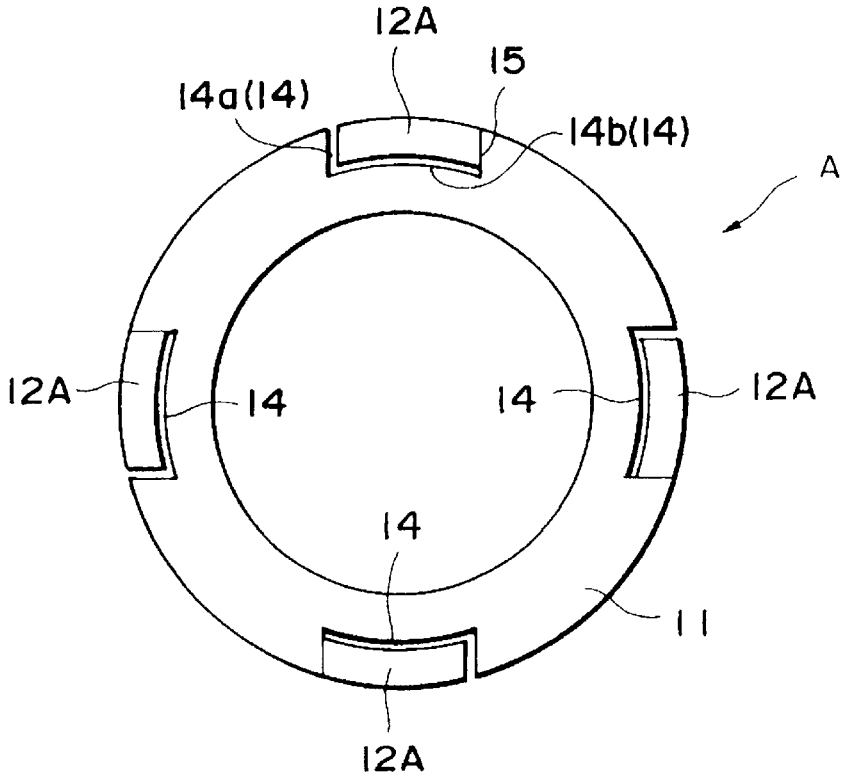
FIG. 3 is a plan view showing a state in which L-shaped slits are formed in the first brazing agent shown in FIG. 2.
Figure 4:
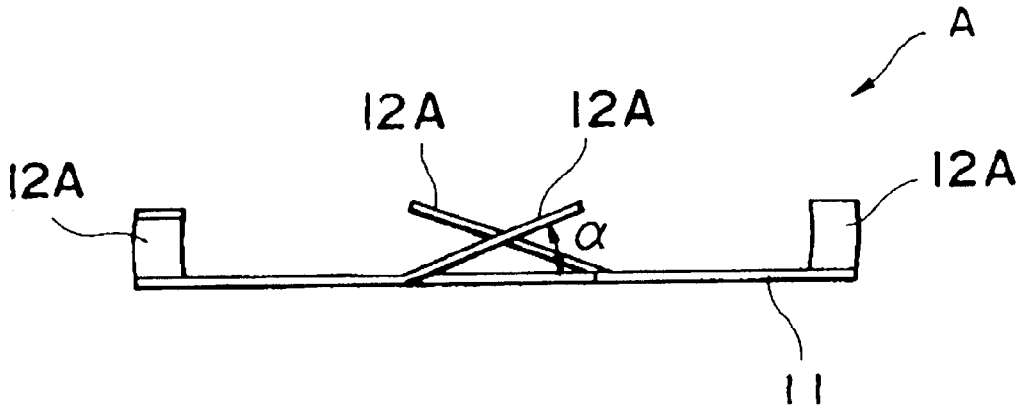
FIG. 4 is a front view of the first brazing agent shown in FIG. 2.

As shown in FIGS. 2 through 4, the first brazing agent A includes a main segment 11 in a ring shaped sheet like configuration (thickness of 0.1 mm) and formed of silver (Ag). The main segment 11 has four projecting portions 12 projecting from the surface thereof and spaced from each other at equal interval. Each projecting portion 12 will provide a positive gap K between the stem 3 and the flange portion 8*a* of the focussing electrode 8 during assembly of the x-ray tube 1, so that gas can be discharged through the gap K (see FIG. 9).

Each projecting portion 12 is in the form of an upright pawl 12A provided by cutting a part of the main segment 11 and bending the cut part upwardly. That is, as shown in FIG. 3, each upright pawl 12A is provided by forming an L-shaped slit 14 cut inwardly from an outer peripheral edge of the main segment 11, and by folding the cut part. The slit 14 includes a first slit 14*a* extending inwardly (approximately in a radial direction) from the outer peripheral edge of the main brazing segment 11, and a second slit 14*b* extending from an inner end of the first slit 14*a* in a circumferential direction of the main segment. Each upright pawl 12A is formed by folding the cut part into V shape with respect to the surface of the main segment 11 along a folding line 15 connecting a distal end of the second slit 14*b* and the outer peripheral edge of the main segment 11. In this case, the folding angle $\alpha$ is preferably about 20 degrees.(see FIG. 4)

Figure 5:
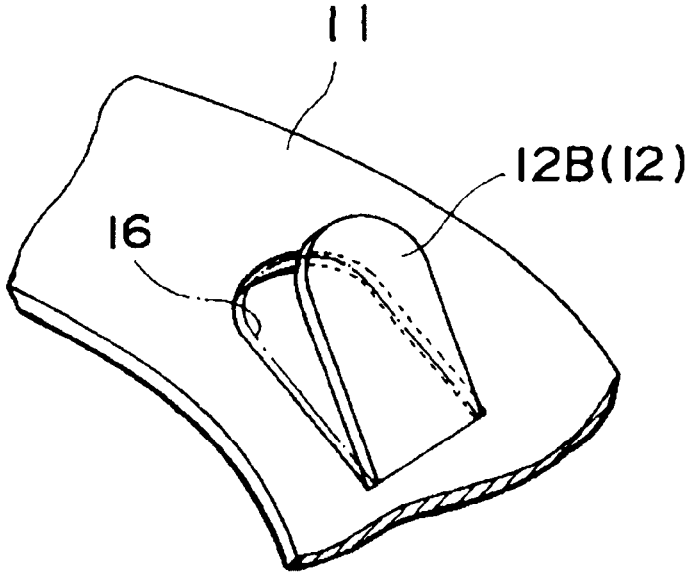
FIG. 5 is an enlarged perspective view showing an essential portion of a first brazing agent according to a modified embodiment.

Incidentally, for the tree dimensional fabrication of the first brazing agent A, a U-shaped slit 16 can be formed at the main segment 11 to provide an upright pawl 12B as shown in FIG. 5. Alternatively, a V-shaped slit (not shown) can be formed at the main segment 11 to provide an upright pawl. In a further modification, a separate upright pawl can be attached to the surface of the ring shaped main segment 11. Further, a button like brazing agent can be used instead of the upright pawls as far as the brazing agent can provide a positive gap between the stem 3 and the flange portion 8*a* of the focussing electrode 8.

Figure 6:
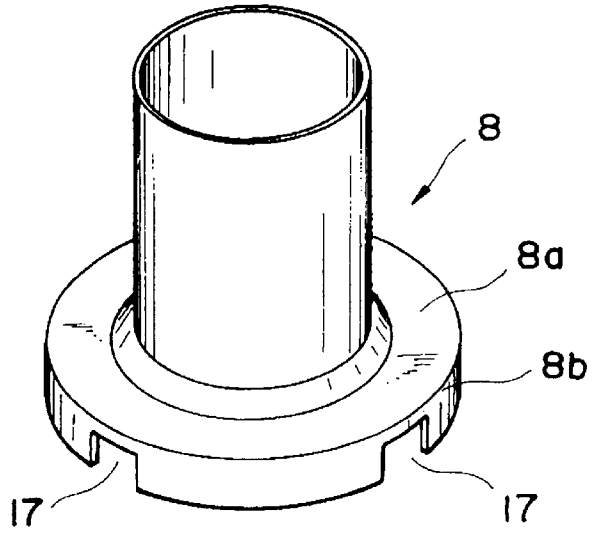
FIG. 6 is a perspective view showing a focussing electrode applied in the x-ray tube production method of the present invention.
Figure 7:
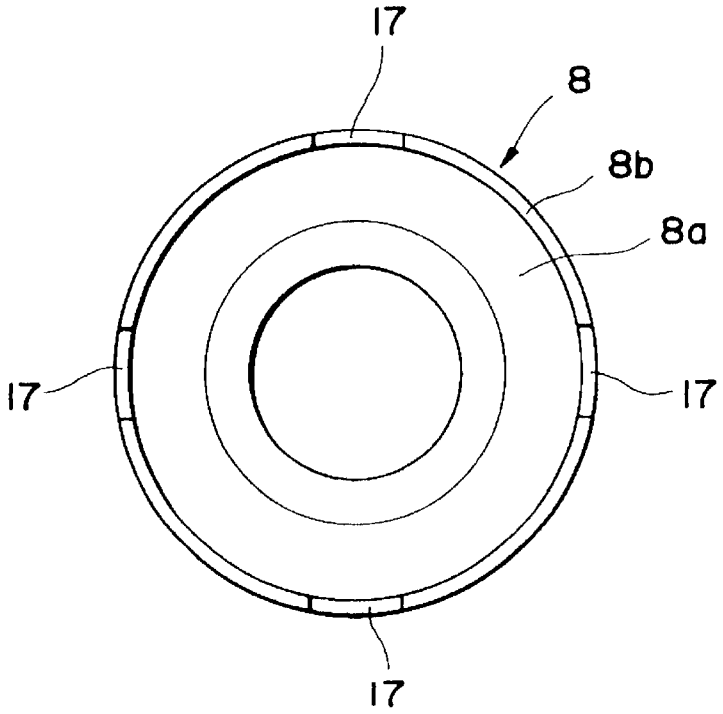
FIG. 7 is a bottom view showing the focussing electrode of FIG. 6.

As shown in FIGS. 6 and 7, the skirt portion 8*b* of the focussing electrode 8 is formed with four gas discharge ports 17. Position of each gas discharge port 17 corresponds to each upright pawl 12A of the first brazing agent A. Thus, efficient gas discharge results. Even if the skirt portion 8*b* is provided at the focussing electrode 8, gas discharge from the bulb 2 can be reliably performed by properly forming the gas discharge ports 17 at the skirt portion 8*b* (see FIG. 9).

Next, a method of producing the x-ray tube 1 using the specific first brazing agent A and the focussing electrode 8 will be described.

Figure 8:
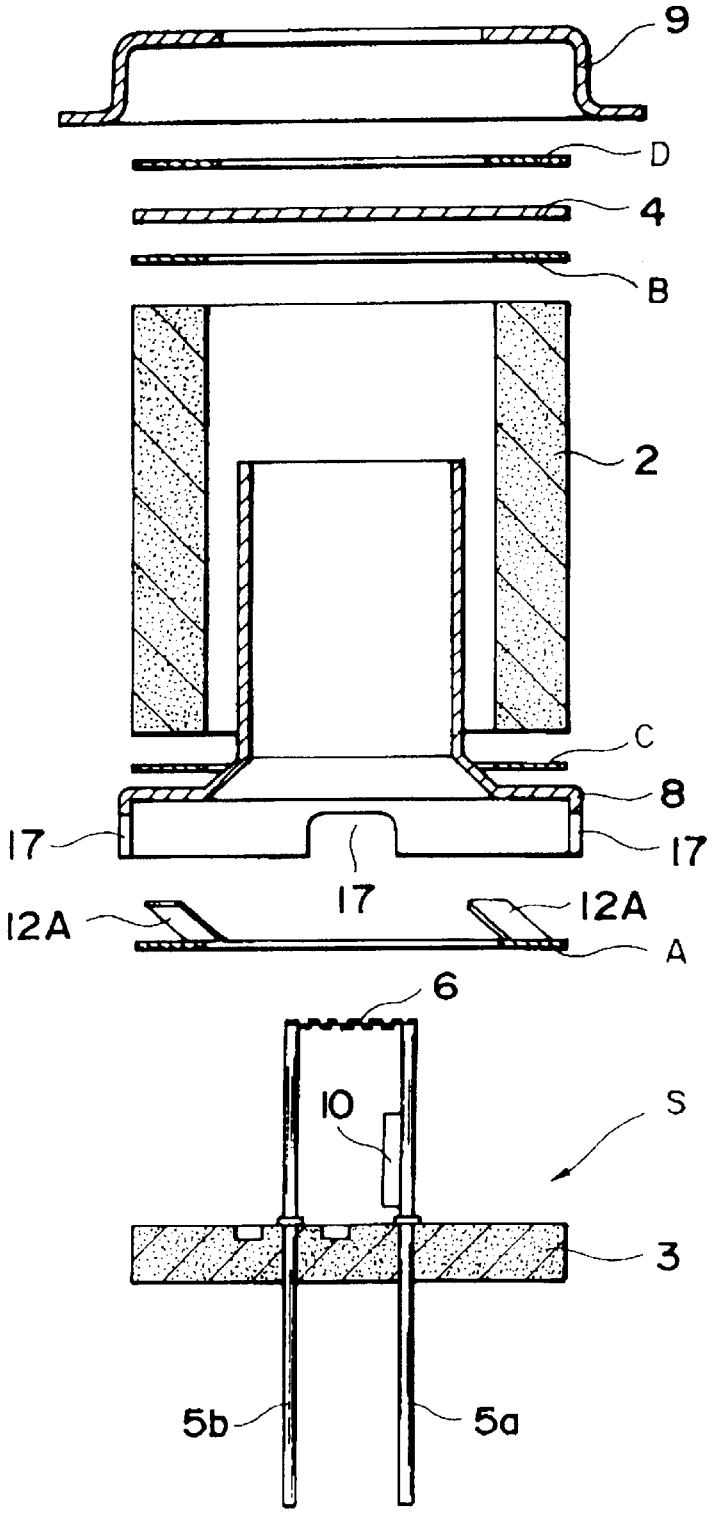
FIG. 8 is a fragmentary cross-sectional view showing arrangement relation of components before the x-ray tube is assembled.
Figure 9:
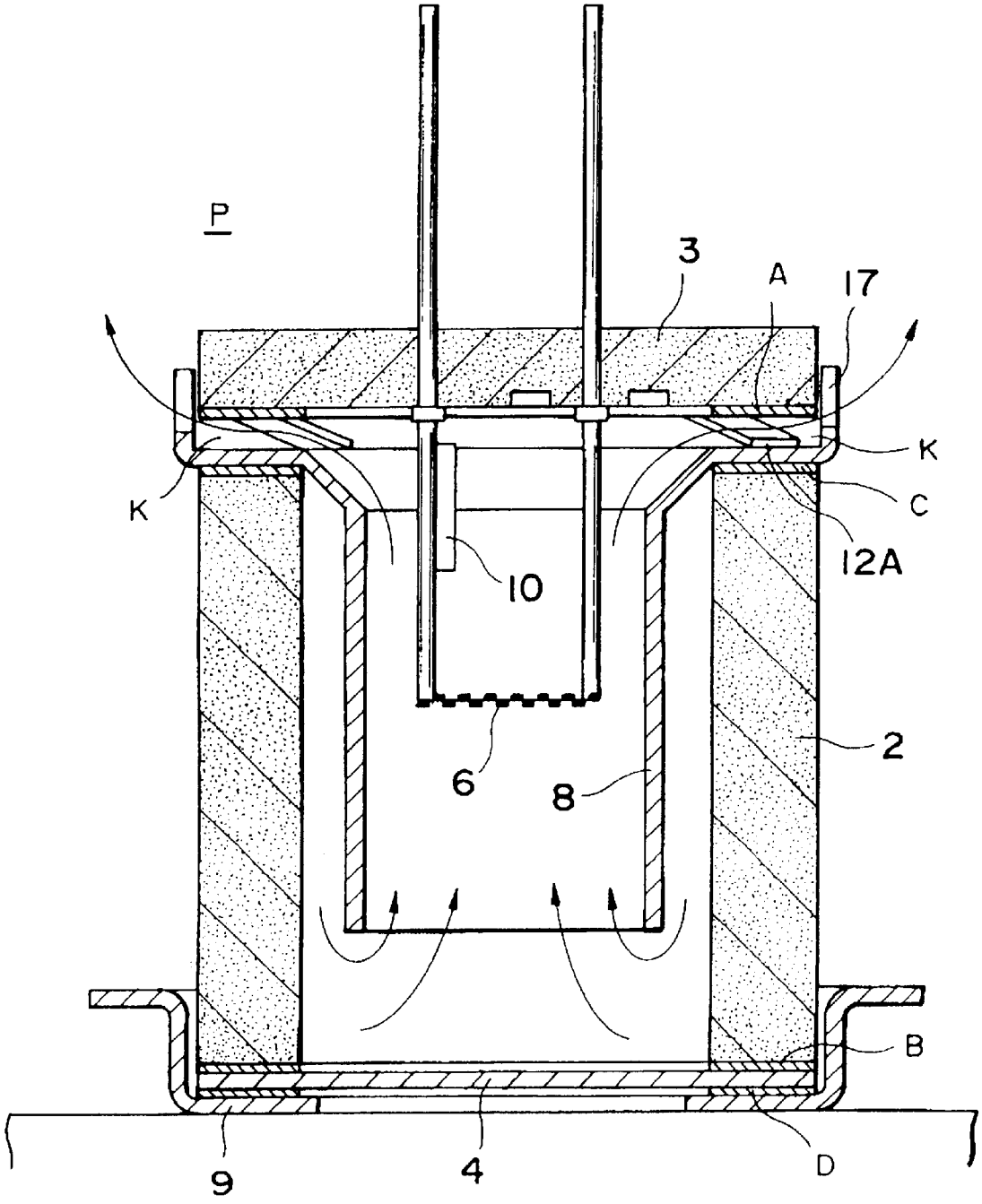
FIG. 9 is a cross-sectional view showing a pre-assembled state of the x-ray tube set in a vacuum brazing oven.

As shown in FIG. 8, first, a stem assembly body S is prepared. The assembly is prepared by fixing the cathode filament 6 and the getter 10 to predetermined positions of the cathode pins 5*a*, 5*b*, and then, these cathode pins are inserted through the stem 3. These cathode pins 5*a* and 5*b* are then fixed to the stem 3 with the brazing agent. Afterward, the third brazing agent C, the focussing electrode 8, the first brazing agent A, and the stem assembly body S are stacked in this order at the one end of the bulb 2. Further, the second brazing material B, the output window 4, the fourth brazing agent D, and the cap 9 are stacked in this order with respect to the other end of the bulb 2. This stacking condition is set in a desired jig (not shown). While this condition is maintained, the x-ray tube 1 in the temporally assembled condition is transported into a vacuum brazing oven P and with the cap 9 facing downward as shown in FIG. 9.

At this time, the gap K-for discharging gas is formed between the stem 3 and the flange portion 8*a* of the focussing electrode 8 by the four upright pawls 12A provided in the first brazing agent A. Further, efficient gas discharge is achievable by positioning each gas discharge port 17 of the focussing electrode 8 in alignment with each upright pawl 12A of the first brazing agent A. Incidentally, in FIG. 9, the position of the gas discharge port 17 and the upright pawl 12A is not coincident with each other for the sake of the illustrating the present arrangement.

After maintaining this temporally assembled condition inside the vacuum brazing oven P (hereinafter simply referred to as an oven) then evacuation to bring the inside of the oven P to vacuum are started. The air within the bulb 2 continues to be discharged through the gap K in association with this evacuation. At the timing of when the inside of the oven P reaches not less than $1\times10^{-5}$ Torr, then heating of the oven P is started. Temperature is increased until the inside of the oven P reaches around 800° C. At this time, the first through fourth brazing agent A to D melt and simultaneously each of the upright pawls 12A melts so that brazing connection of all components can be achieved at once, while maintaining the inside of the vessel 7 in a high vacuum condition. Further, residual gas in the vessel 7 is absorbed by the getter 10, thereby increasing the vacuum in the vessel 7 so that even a higher quality x-ray tube 1 can be obtained in the oven P.

Afterward, when the oven P is gradually cooled off and leaked, an x-ray tube 1 with both sealing and air discharge operations completed can be obtained. By using this production method, the object taken out of the oven P already has the substantial shape of the final product so the method is available for mass production.

Figure 10:
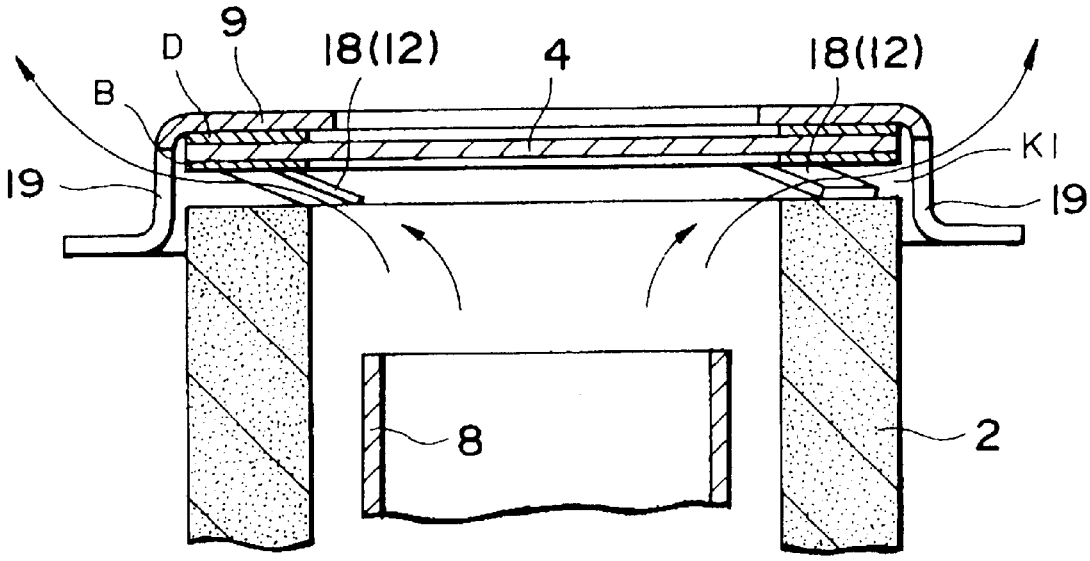
FIG. 10 is a cross-sectional view showing an essential portion of an x-ray tube including a second brazing agent provided with upright pawls.
Figure 11:
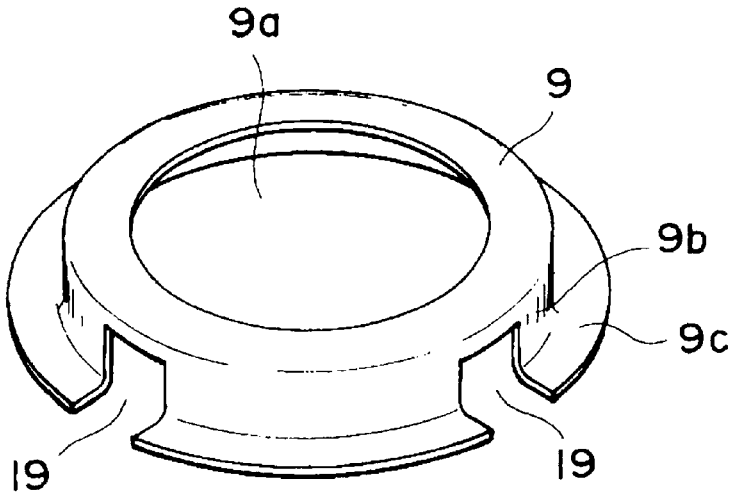
FIG. 11 is perspective view showing a cap formed with a gas discharge port.

The present invention is not limited to the above described embodiments. For example, as shown in FIG. 10, the second brazing agent B can be configured similar to the above described first brazing agent A. That is, four upright pawls 18 are provided as the projecting portions in the second brazing agent B, so that gas charging gap K1 can be formed between the bulb 2 and the output window 4. Further, as shown in FIG. 11, a cap 9 can be formed with four gas discharge ports 19 notched at the sleeve portion 9*b* and the flange portion 9*c*. Efficient gas discharge is achievable by aligning each gas discharge port 19 with each upright pawl 18 of the second brazing agent B. In this way, even if the sleeve portion 9*b* is provided at the cap 9, gas discharge from the bulb 2 can be reliably performed during assembly of the x-ray tube by forming the gas discharge ports 19 at the sleeve portion 9*b* of the cap 9. Incidentally, gas discharging efficiency from the bulb 2 can further be promoted if the second brazing agent B having the upright pawls 18 and the first brazing agent A having the upright pawls 12A are concurrently used during fabrication of the x-ray tube 1.

INDUSTRIAL APPLICABILITY

The x-ray tube according to the present invention can be used inside air cleaning devices, and used broadly for industry and medical purposes, such as removing charges and neutralizing static electricity from IC, films, powders, and the like by the irradiation of weak x-rays, and removing charges from plastic molded products removed from a metal mold or die.

What is claimed is:

1. A method for producing an x-ray tube which includes a sealed vessel provided with a bulb having one open end and another open end, a stem fixed to the one open end of the bulb through a first brazing agent, and an output window fixed to the another open end of the bulb through a second brazing agent, a filament disposed in the sealed vessel for emitting electrons, and a focussing electrode disposed in the sealed vessel and surrounding the filament, incidence of the electron from the filament into the output window providing x-ray discharge outwardly through the output window, the method comprising the steps of;

interposing a flange portion of the focussing electrode between the bulb and the stem, the flange portion having an outer peripheral end portion provided with a skirt portion where a gas discharge port allowing an inside of the bulb to communicate with an outside is formed;

positioning a projecting portion of the first brazing agent between the stem and the flange portion of the focussing electrode for maintaining the stem away from the flange portion, and positioning a third brazing agent between the flange portion and the bulb, and positioning the second brazing agent between the bulb and the output window to provide a temporary assembly of the x-ray tube; and disposing the temporary assembly of the x-ray tube in a vacuum brazing oven, and discharging gas from an inside space of the vessel defined by the bulb, the stem and the output window through a gap between the flange portion and the stem, the gap being provided by the projecting portion of the first brazing agent.

2. The method for producing the x-ray tube as claimed in claim 1, wherein the projecting portion of the first brazing agent, the first brazing agent, the second brazing agent and the third brazing agent are melted by increasing the temperature of the vacuum brazing oven to a predetermined temperature to perform brazing connection between the flange portion and the stem, between the bulb and the flange portion, and between the bulb and the output window, while the discharge of gas from the inside space is continued.

3. The method for producing the x-ray tube as claimed in claim 1, wherein the gas discharge port is positioned in association with the projecting portion of the first brazing agent.

4. The method for producing the x-ray tube as claimed in claim 1, wherein the projecting portion provided at the first brazing agent is formed of a material identical with the material of the first brazing agent.

5. The method for producing the x-ray tube as claimed in claim 1, wherein the first brazing agent is formed of a ring shaped sheet like member, the projecting portion comprising an upright pawl formed by cutting a part of the first brazing agent and folding the cut part.

6. The method for producing the x-ray tube as claimed in claim 1, wherein the second brazing agent is provided with a projecting portion which spaces the output window away from the bulb to provide a gap through which gas discharge is performed.

7. The method for producing the x-ray tube as claimed in claim 6, wherein the projecting portion at the second brazing agent is formed of a material identical with the material of the second brazing agent.

8. The method for producing the x-ray tube as claimed in claim 6, wherein the second brazing agent is formed of a ring shaped sheet like member, the projecting portion of the second brazing agent comprising an upright pawl formed by cutting a part of the second brazing agent and folding the cut part.

9. The method for producing the x-ray tube as claimed in 6, wherein a cap surrounding the output window is provided, the output window being interposed between the bulb and the cap; and wherein a fourth brazing agent is positioned between the output window and the cap, the projecting portion of the second brazing agent spacing the output window away from the bulb to provide a gap through which gas discharge is performed.

10. The method for producing the x-ray tube as claimed in claim 9, wherein the cap includes a sleeve portion surrounding the end portion of the bulb, the sleeve portion being formed with a gas discharge port which communicates an inside of the bulb with an outside.

11. The method for producing the x-ray tube as claimed in claim 10, wherein the gas discharge port of the cap is positioned in association with the projecting portion of the second brazing agent.

12. A method for producing an x-ray tube which includes a sealed vessel provided with a bulb having one open end and another open end, a stem fixed to the one open end of the bulb through a first brazing agent, and an output window fixed to the another open end of the bulb through a second brazing agent, and a filament disposed in the sealed vessel for emitting electrons, incidence of the electrons into the output window providing x-ray discharge outwardly through-the output window, the method comprising the steps of;

interposing the output window between the bulb and a cap surrounding the output window, the cap having a sleeve portion surrounding the end portion of the bulb, the sleeve portion being formed with a gas discharge port which communicates the inside of the bulb with the outside;

positioning the first brazing agent between the bulb and the stem, positioning a projecting portion of the second brazing agent between the bulb and the output window, and positioning a fourth brazing agent between the output window and the cap to provide a temporary assembly of the x-ray tube where the output window is spaced away from the bulb; and disposing the temporary assembly of the x-ray tube in a vacuum brazing oven, and discharging gas from an inside space of the vessel defined by the bulb, the stem and the output window through a gap between the bulb and the output window, the gap being provided by the projecting portion of the second brazing agent.

13. The method for producing the x-ray tube as claimed in claim 12, wherein the first brazing agent, the projecting portion of the second brazing agent, the second brazing agent, and the fourth brazing agent are melted by increasing the temperature of the vacuum brazing oven to a predetermined temperature to perform brazing connection between the bulb and the stem and between the bulb and the output window, while the discharge of gas from the inside space is continued.

* * * * *